US005673683A

United States Patent [19]

Beal et al.

[11] Patent Number: 5,673,683

[45] Date of Patent: Oct. 7, 1997

[54] INDUCED DRAFT FIREPLACE

[75] Inventors: Thomas J. Beal, Ossian; Robert E. Cabrera, Lafayette, both of Ind.

[73] Assignee: The Majestic Products Company, Huntington, Ind.

[21] Appl. No.: 730,576

[22] Filed: Oct. 15, 1996

Related U.S. Application Data

[63] Continuation of Ser. No. 283,996, Aug. 1, 1994, abandoned.

[51] Int. Cl.[6] ..... F24B 1/189

[52] U.S. Cl. ..... 126/531; 126/512; 126/519

[58] Field of Search ..... 126/500, 512, 126/531, 528, 529, 519, 515, 516, 517, 518, 108, 110 R, 116 R

[56] References Cited

U.S. PATENT DOCUMENTS

| | | | |
|---|---|---|---|
| 507,017 | 10/1893 | Krueger | 126/108 |
| 2,052,643 | 9/1936 | Modine | 126/121 |
| 2,346,876 | 4/1944 | Torr | 126/116 R |
| 2,430,393 | 11/1947 | Elmore | 126/110 |
| 2,622,587 | 12/1952 | Dupler | 126/512 |
| 3,749,078 | 7/1973 | Dupler | 126/512 |
| 4,129,114 | 12/1978 | Hiser | 126/122 |
| 4,143,638 | 3/1979 | Kamstra | 126/121 |
| 4,182,305 | 1/1980 | Johnson | 126/531 X |
| 4,206,742 | 6/1980 | Johnson | 126/66 |
| 4,432,337 | 2/1984 | Gregory | 126/121 |
| 4,512,329 | 4/1985 | Sweet | 126/121 |
| 4,519,376 | 5/1985 | Schoeff | 126/121 |
| 4,558,688 | 12/1985 | Piazzetta | 126/67 |
| 4,793,322 | 12/1988 | Shimek et al. | 126/531 X |
| 4,836,182 | 6/1989 | Trowbridge | 126/109 |
| 4,860,725 | 8/1989 | Tallman et al. | 126/116 R X |
| 4,867,673 | 9/1989 | Harrigill | 126/108 X |
| 4,889,181 | 12/1989 | Meijer | 126/108 X |
| 4,971,030 | 11/1990 | Thow | 126/512 |
| 5,009,219 | 4/1991 | Liet | 126/523 |
| 5,092,313 | 3/1992 | Blackburn | 126/512 |
| 5,218,953 | 6/1993 | Shimek et al. | 126/512 |
| 5,249,567 | 10/1993 | Maitland et al. | 126/512 X |
| 5,303,693 | 4/1994 | Schroeter et al. | 126/512 X |
| 5,388,566 | 2/1995 | Smith et al. | 126/512 |
| 5,421,321 | 6/1995 | Ward | 126/512 X |

FOREIGN PATENT DOCUMENTS

| | | | |
|---|---|---|---|
| 2544466 | 10/1984 | France | 126/529 |

*Primary Examiner*—Carl D. Price
*Attorney, Agent, or Firm*—Baker & Daniels

[57] ABSTRACT

The invention is directed to an induced draft fireplace including a plurality of outer walls defining an outer housing. The outer walls include at least one outer side wall and an outer top wall. A plurality of inner walls define a combustion chamber. The inner walls include at least one inner side wall and an inner top wall having an outlet opening. A room air circulation channel is defined by and disposed between the outer housing and the inner housing. The room air circulation channel has an inlet and an outlet. A heat exchanger is disposed in the room air circulation channel, and includes an inlet connected to and in fluid communication with the outlet opening, and an outlet. The heat exchanger includes a plurality of walls defining at least two flow paths extending in different directions, the at least two flow paths defining a total change in flow direction within the heat exchanger of at least 180°. A fan having an inlet is connected to and in fluid communication with the heat exchanger outlet. The fan also has an outlet for connection to a flue for transport of products of combustion from the combustion chamber.

18 Claims, 6 Drawing Sheets

INDUCED DRAFT FIREPLACE

This is a continuation of application Ser. No. 08/283,996, filed Aug. 1, 1994 now abandoned.

BACKGROUND OF THE INVENTION

1. Field of the Invention

The present invention relates to a fireplace, and, more particularly, to a fireplace having an induced draft fan for exhausting combustion products from the fireplace.

2. Description of the Related Art

Fireplaces of conventional design typically include a flue which is attached to the top or upper rear of the fireplace and which is in fluid communication with the interior of the combustion chamber for transport of combustion products to the outside ambient environment. Transport of the combustion products to the outside ambient environment occurs as a result of a natural draft effected by the hot gases produced within the combustion chamber. A problem with conventional fireplaces utilizing natural draft is that usually only vertical venting is possible. That is, a vertically vented fireplace has substantially more natural draft than a horizontally vented fireplace, and the combustion products can be adequately exhausted to the outside ambient environment. For a conventional fireplace having access doors which are not hermetically sealed, a horizontally vented fireplace may not have sufficient draft to ensure that all combustion products are exhausted to the environment.

Fireplaces having a sealed combustion chamber and a horizontally vented flue must provide a source of combustion air to the interior of the combustion chamber from the outside ambient environment. A plenum or conduit of some sort is typically used for this purpose. However, to ensure that reverse flow does not occur through the flue and plenum, i.e., combustion products flowing through the combustion air plenum, it is necessary to ensure that the ambient pressure at the plenum inlet and the flue outlet is generally the same. This design consideration requires that the plenum inlet and flue outlet be disposed relatively close to each other, such as with a direct vent fireplace having a coaxial flue assembly.

From the foregoing discussion, it is apparent that the location where the flue is attached to the fireplace is limited with a natural draft system. For most applications, the flue is attached to the top of the fireplace. Even where it is possible to vent in a horizontal direction, design criteria necessary to ensure that the combustion products are exhausted to the ambient environment mandate an increase in cost and reduced flexibility in location of components.

Induced draft fireplaces, also known as power vent fireplaces, overcome some of the problems with conventional designs by allowing greater flexibility in the attachment location of the flue to the fireplace. With such a system, a fan is disposed in the conduit extending from the combustion chamber through which the combustion products are transported. The outlet of the fan is attached to the flue, which in turn is in fluid communication with the outside ambient environment. By inducing a draft and thereby inducing a flow of combustion products from the combustion chamber, the flue may extend in any desired direction, including horizontal venting. Moreover, in contrast with horizontally vented fireplaces using natural drafts wherein the horizontally disposed vent is located at the top of the combustion chamber, an induced draft fireplace may have a horizontally vented flue which is disposed at the bottom portion of the fireplace. Thus, it is also possible to induce a flow of combustion products in a downward direction utilizing an induced draft fireplace. Such flow is not possible utilizing a natural draft system.

What is needed in the art is a fireplace which allows flexibility in terms of venting a fireplace at one of a plurality of desired locations, while overcoming the problems of relatively low reliability and high repair costs associated with known induced draft fireplaces.

SUMMARY OF THE INVENTION

The present invention provides an induced draft fireplace having a heat exchanger which is disposed in a room air circulation channel, and which has a plurality of walls defining at least two flow paths extending in different directions, with a total change in flow direction within the heat exchanger of at least 180° (i.e., excluding changes in flow direction at the inlet and outlet of the heat exchanger).

The room air circulation channel is disposed between an outer housing and inner housing. The outer housing includes four sidewalls, which are more particularly referred to as an outer front wall, an outer rear wall and two outer sidewalls. The outer front wall and outer rear wall are at least partially defined by a glass panel or door allowing visual inspection and/or access to the interior of the fireplace. Optionally, one of the outer sidewalls also may also be defined at least in part by a glass panel or door.

The outer housing and inner housing also include an outer top wall and an inner top wall, respectively. The heat exchanger is disposed in the room air circulation channel between the outer top wall and the inner top wall. In comparison with induced draft fireplaces of conventional design, the heat exchanger of the present invention includes an elongated flow path which is effected by providing a circuitous flow path within the heat exchanger. The flow path through the heat exchanger defines a total change in flow direction within the heat exchanger of at least 180°. This may be accomplished by providing a single 180° change in flow direction, i.e., a two-pass heat exchanger, or two 90° changes in flow direction. Of course, more changes in the flow direction generally corresponds to a longer flow path, which is desirable for heat exchange purposes.

Room air is forced through the room air circulation channel utilizing a blower and flows over the surface of the heat exchanger. The relatively long flow path within the heat exchanger, in conjunction with the relatively cool air flowing over the heat exchanger as a result of air circulated through the room air circulation channel, results in sufficient cooling of the combustion products drawn through the heat exchanger to significantly reduce the chances of damage to the fan through which the combustion products flow.

The invention comprises, in one form thereof, an induced draft fireplace including a plurality of outer walls defining an outer housing. The outer walls include at least one outer side wall and an outer top wall. A plurality of inner walls define a combustion chamber. The inner walls include at least one inner side wall and an inner top wall having an outlet opening. A room air circulation channel is defined by and disposed between the outer housing and the inner housing. The room air circulation channel has an inlet and an outlet. A heat exchanger is disposed in the room air circulation channel, and includes an inlet connected to and in fluid communication with the outlet opening, and an outlet. The heat exchanger includes a plurality of walls defining at least two flow paths extending in different directions, the at least two flow paths defining a total change in flow direction within the heat exchanger of at least 180°. A fan having an inlet is connected to and in fluid communication with the heat exchanger outlet. The fan also has an outlet for connection to a flue for transport of products of combustion from the combustion chamber.

In another form of the invention, the outer walls defining the outer housing include an outer top wall, an outer bottom wall and four outer sidewalls. At least two of the four outer sidewalls comprise a glass panel. The inner walls defining the combustion chamber include an inner top wall having an outlet opening which is generally centered in the inner top wall.

An advantage of the present invention is that the combustion products are sufficiently cooled prior to entering the fan to prevent damage thereto caused by extreme temperature operating conditions.

Another advantage is that repair and/or replacement costs to the fan can be reduced.

Yet another advantage is that the existing air flow through conventional structure, i.e., a room air circulation channel, is utilized for cooling the hot combustion products flowing through the heat exchanger.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
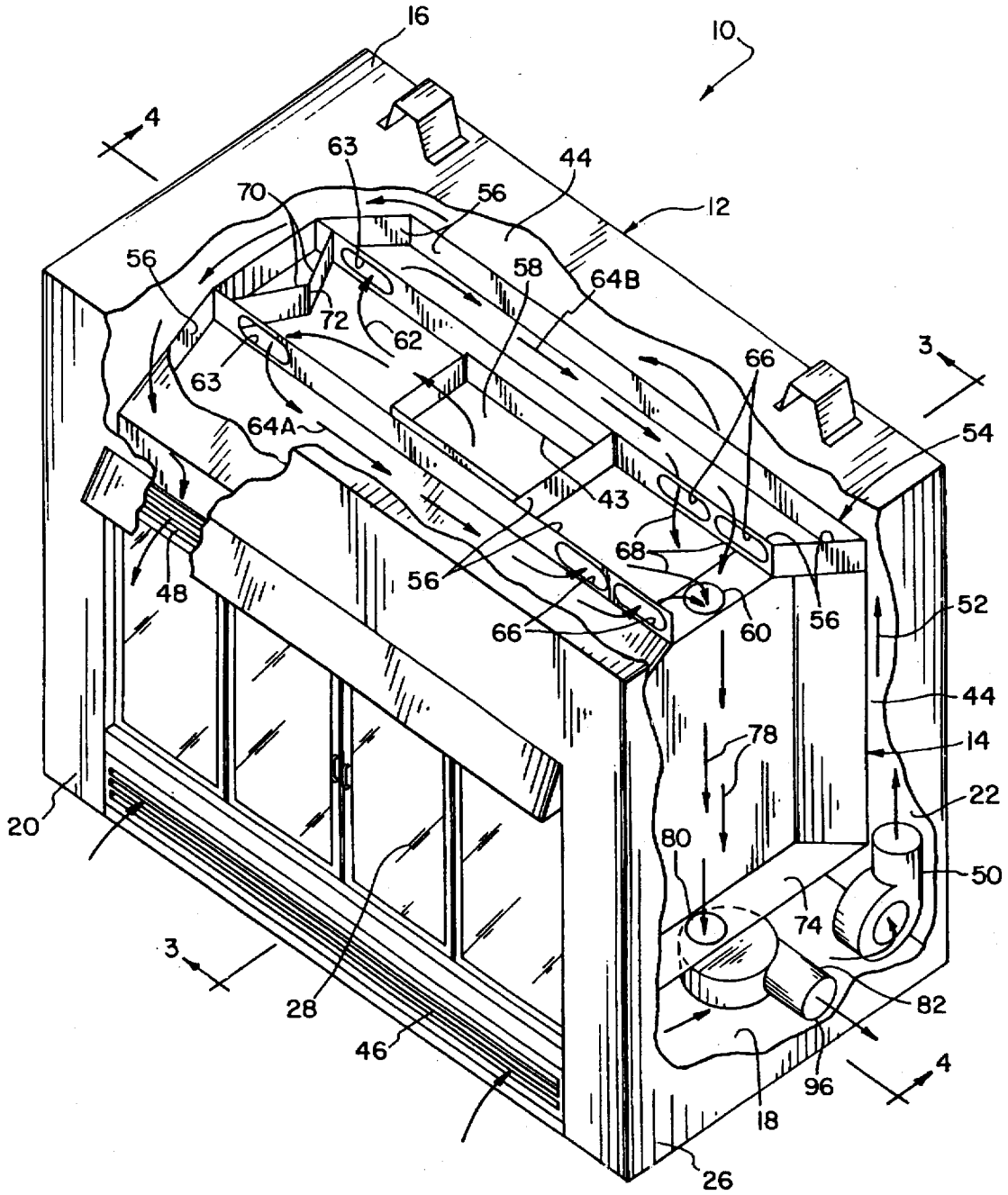
FIG. 1 is a cut-away perspective view of a two-sided fireplace of the present invention, illustrating air flow through the room air circulation channel and heat exchanger.
Figure 2:
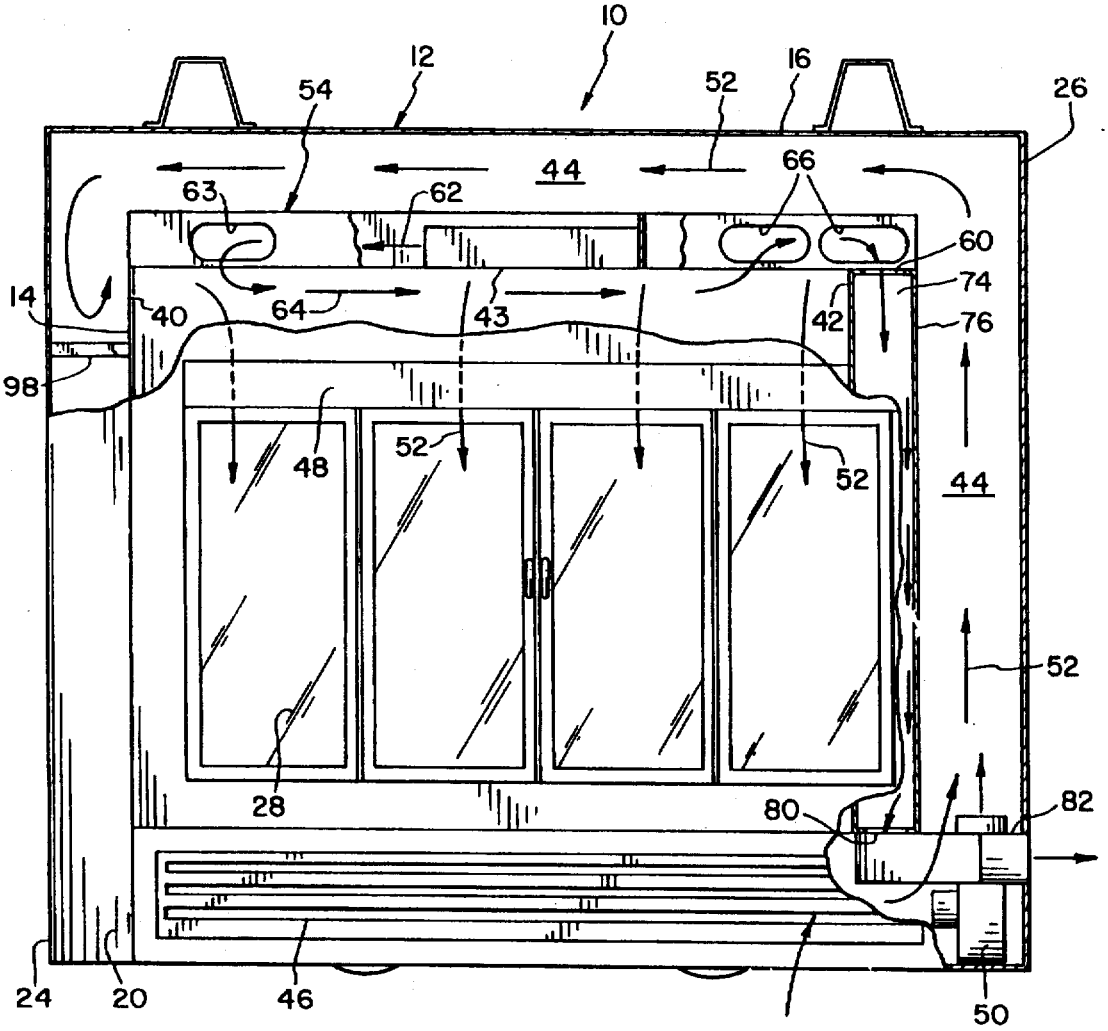
FIG. 2 is cut-away front view of the fireplace of FIG. 1.

Referring now to the drawings and particularly to FIGS. 1–4, there is shown an induced draft fireplace 10 including an outer housing 12 and an inner housing 14. Outer housing 12 includes an outer top wall 16, and outer bottom wall 18, and four outer side walls extending therebetween. The four outer side walls may be more particularly referred to as an outer front wall 20, and outer rear wall 22, and two outer side walls 24, 26.

Figure 3:
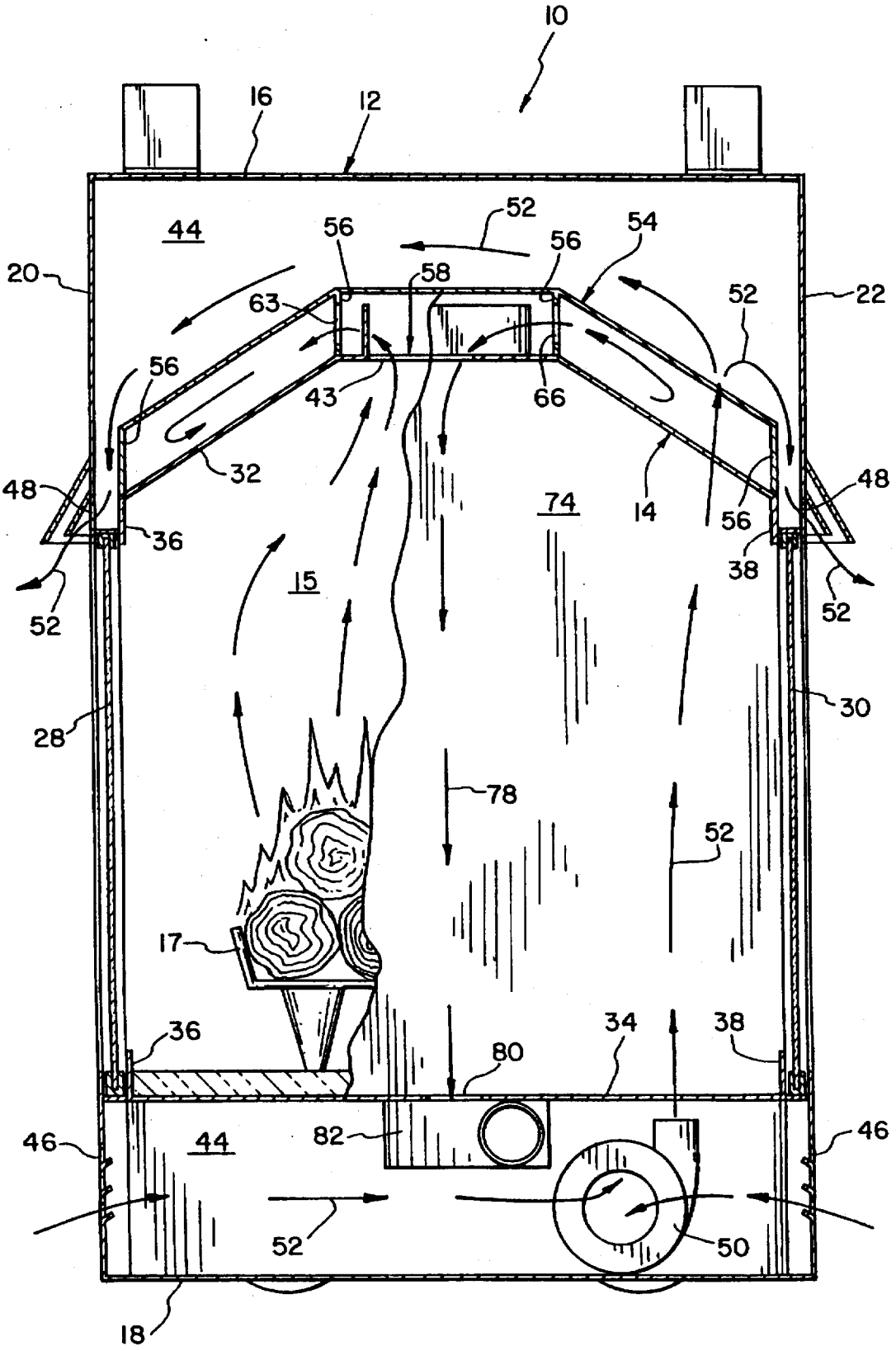
FIG. 3 is a sectional view of the fireplace of FIG. 1 taken along line 3—3.
Figure 4:
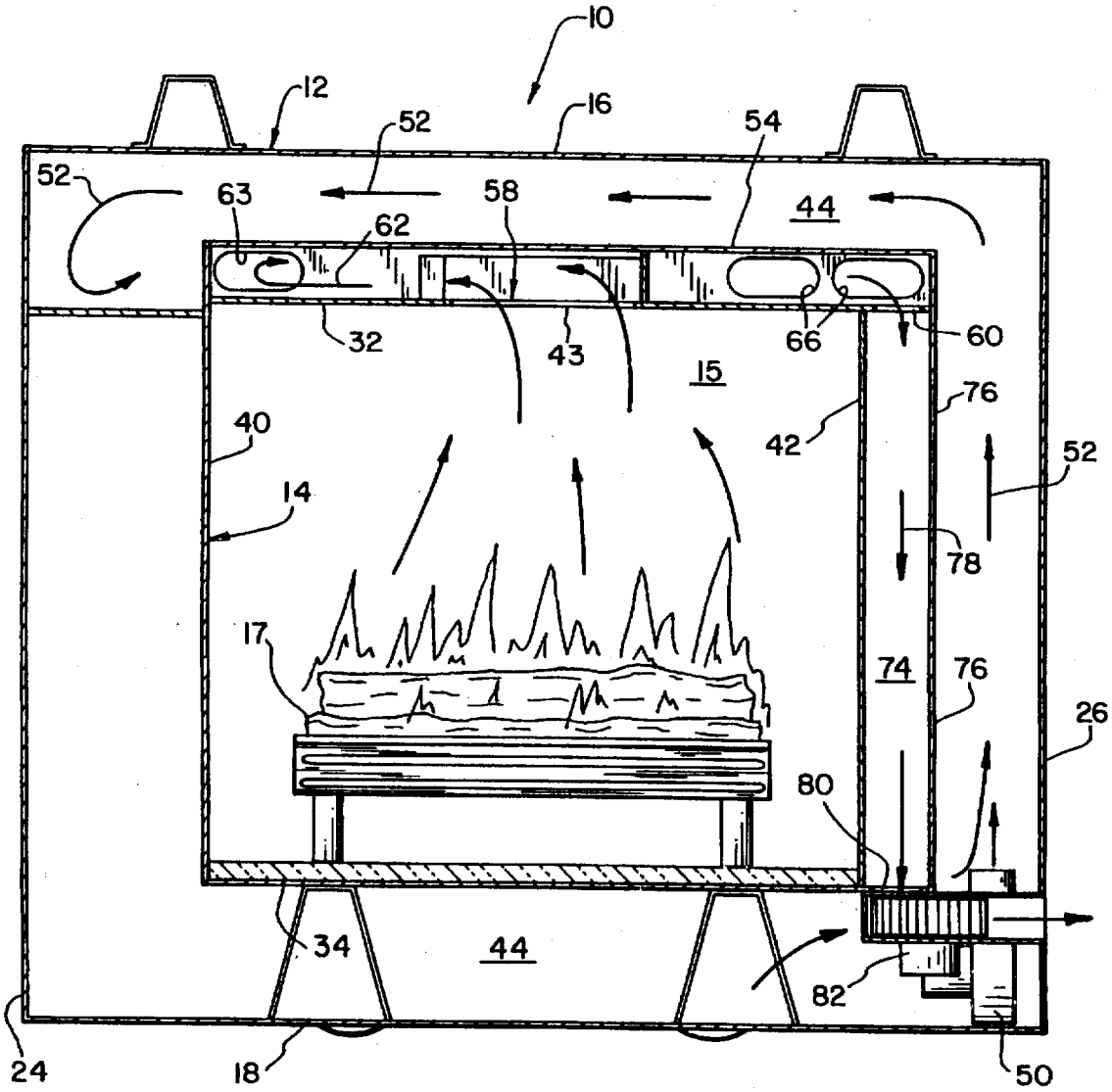
FIG. 4 is a sectional view of the fireplace of FIG. 1 taken along line 4—4.

Referring to FIGS. 1 and 3, conjunctively, it may be seen that each of outer front wall 20 and outer rear wall 22 respectively include glass doors 28, 30. Glass doors 28, 30 allow visual inspection of and access to the interior of fireplace 10. Since induced draft fireplace 10 includes two glass doors 28, 30, the fireplace is referred to as a two-sided fireplace.

Inner housing 14 defining a combustion chamber 15 and includes an inner top wall 32, an inner bottom wall 34, an inner front wall 36, an inner rear wall 38 and two inner side walls 40, 42. Inner top wall 32 includes an outlet opening 43 formed therein. Disposed within combustion chamber 15 is a gas log set 17 of conventional construction. Referring to FIG. 3, it may be seen that inner front wall 36 and inner rear wall 38 each include a cut out opening therein which generally corresponds to the size and shape of glass doors 28, 30.

Disposed between and defined by outer housing 12 and inner housing 14 is a room air circulation channel 44 through which air from the room in which the fireplace is located is circulated. Room air circulation channel 44 includes inlets 46 disposed below glass doors 28, 30, and outlets 48 disposed above glass doors 28, 30. A blower 50 is disposed and effects a flow of forced air within room air circulation channel 44, as indicated by air flow directional arrows 52. Air flowing through room air circulation channel 44 is heated via convection as it flows therethrough, and is exhausted through outlets 48 at an elevated temperature, relative to the air temperature at inlets 46.

A heat exchanger 54 is disposed within room air circulation channel 44 between outer top wall 16 and inner top wall 32. Heat exchanger 54 includes an inlet 58 and an outlet 60. Heat exchanger 54 also includes a plurality of walls 56 defining at least two flow paths through heat exchanger 54 from inlet 58 to outlet 60. The term "flow path", as it applies to fluid flow through heat exchanger 54, is defined herein as a flow of combustion products through heat exchanger 54 generally in one direction, and does not include flow through turns within the heat exchanger. That is, referring to FIG. 1, a first flow path is indicated generally by directional arrows 62. The combustion products then flow through openings 63 and turn approximately 180° to flow in an opposite direction through a second flow path, indicated generally by directional arrow 64. When the combustion products reach the opposite end of heat exchanger 54, the combustion products turn approximately 90° and flow through openings 66, thereby defining a third flow path indicated generally by arrows 68. Thus, with the embodiment shown in FIGS. 1–4, the flow paths 62, 64 and 66 define a total change in flow direction within heat exchanger 54 which is about 270°. That is, a 180° turn occurs between first flow path 62 and second flow path 64, and a 90° turn occurs between second flow path 64 and third flow path 68, thereby totaling a 270° change in flow direction within heat exchanger 54.

Heat exchanger 54 includes two walls 70 which are joined together at an obtuse angle therebetween, with an adjoining edge 72 disposed in the approximate center of flow within first flow path 62. Combustion products entering heat exchanger 54 through inlet 58 are drawn towards openings 63. Adjoining edge 72 of walls 70 splits the flow of combustion products flowing through the heat exchanger into at least two partial flows defined by second flow paths 64*a* and 64*b*. Reversing the flow of combustion products approximately 180° from first flow path 62 to second flow paths 64*a* and 64*b* results in a two-pass heat exchanger. That is, the flow occurs in one direction, and then in an opposite direction through heat exchanger 54. Moreover, splitting the flow of combustion products utilizing wall 70 results in essentially forming two two-pass heat exchangers. Moreover, by splitting the flow of combustion products, the volumetric space through which the combustion products flow increases with a resultant decrease in pressure and temperature of the combustion products.

In the embodiment shown in FIGS. 1–4, heat exchanger 54 is defined in part by inner top wall 32 of inner housing 14. However, heat exchanger 54 could be formed using sheet metal which is separate from inner top wall 32, thereby making heat exchanger 54 a stand-alone unit which is inserted within room air circulation channel 44.

Moreover, in the embodiment shown in FIGS. 1–4, outlet 60 of heat exchanger 54 is in fluid communication with a plenum 74 defined in part by inner side wall 42 of inner housing 14. Plenum 74 is additionally comprised of an upstanding wall 76 disposed generally parallel with inner side wall 42. Plenum 74 defines a flow path represented by arrows 78 which extends in a generally vertical, and more particularly vertically downward, direction. The inlet to plenum 74 is the same as outlet 60 of heat exchanger 54. Plenum 74 also includes an outlet 80 which is in fluid communication with a fan 82. Plenum 74 also acts as an additional heat exchanger, in addition to heat exchanger 54, because of the room air which is circulated therepast through room air circulation channel 44. However, plenum 74 does not include a plurality of walls, such as walls 56, 70 in heat exchanger 54, which would direct the flow of combustion products therethrough in different directions. Rather, as with designs of known construction, the air flow through plenum 74 generally stays in the center portion of plenum 74, as indicated by directional arrows 78 (FIG. 1). Thus, plenum 74 has relatively inefficient heat transfer capabilities because of a generally straight flow path from inlet 60 to outlet 80.

It is to be understood, however, that plenum 74 could be constructed with a plurality of walls which would define various flow paths through plenum 74 in different directions. In such a case, both heat exchanger 54 and plenum 74 would incorporate the same idea of providing an elongated flow path by providing a plurality of separate flow paths, and thus heat exchanger 54 and plenum 74 would essentially be considered as one integrated heat exchanger.

Alternatively, it might be possible to, in essence, switch the positions of plenum 74 and heat exchanger 54, and provide a heat exchanger of a type incorporating the principals of heat exchanger 54 between outer side wall 26 and inner side wall 42.

In operation, fan 82 is electrically energized and induces a flow of combustion products from combustion chamber 15. The combustion products flow within heat exchanger 54 in the direction of first flow path 62 and are drawn towards openings 63. Walls 70 also help to split the flow in the respective directions toward openings 63. The flow of combustion products then reverses direction 180° and flows back along the sides of the room air circulation channel toward the opposite end of heat exchanger 54. The combustion products then turn approximately 90° and flow through openings 66. The flow then proceeds toward outlet 60, where the flow exits heat exchanger 54 and turns 90° in a downward direction through plenum 74. The flow through plenum 74 is generally through the central portion thereof. Combustion products then enter outlet 80 of plenum 74 and are drawn into fan 82. Outlet 96 of fan 82 is adapted for connection to a flue for transporting the combustion products to an outside ambient environment.

Concurrently with the flow of combustion products through heat exchanger 54 and plenum 74, room air from the room within which the fireplace is located is drawn into room air circulation channel 44 through inlets 46. The room air is blown through room air circulation channel 44 by blower 50 and flows over plenum 74 and heat exchanger 54. Room air contacting outer side wall 24 is deflected downward and flows against a blind wall 98 which prevents formation of stagnant hot air between outer side wall 24 and inner side wall 40. The heated air disposed above heat exchanger 54 turns toward outer front wall 20 and outer rear wall 22 and exits via outlets 48 to the room in which fireplace 10 is located.

Figure 5:
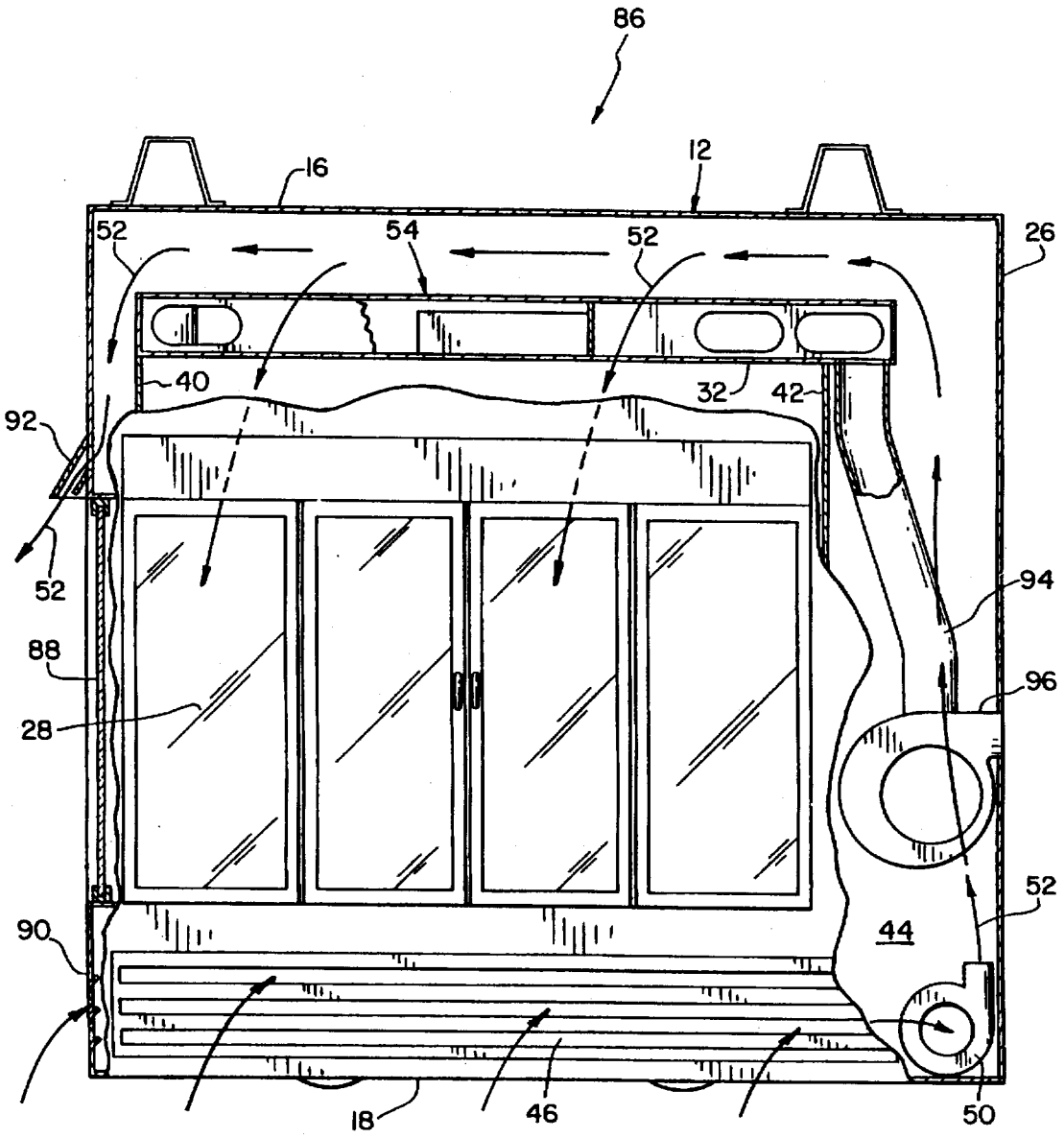
FIG. 5 is a cut-away front view of a three-sided fireplace of the present invention, illustrating air flow through the room air circulation channel.
Figure 6:
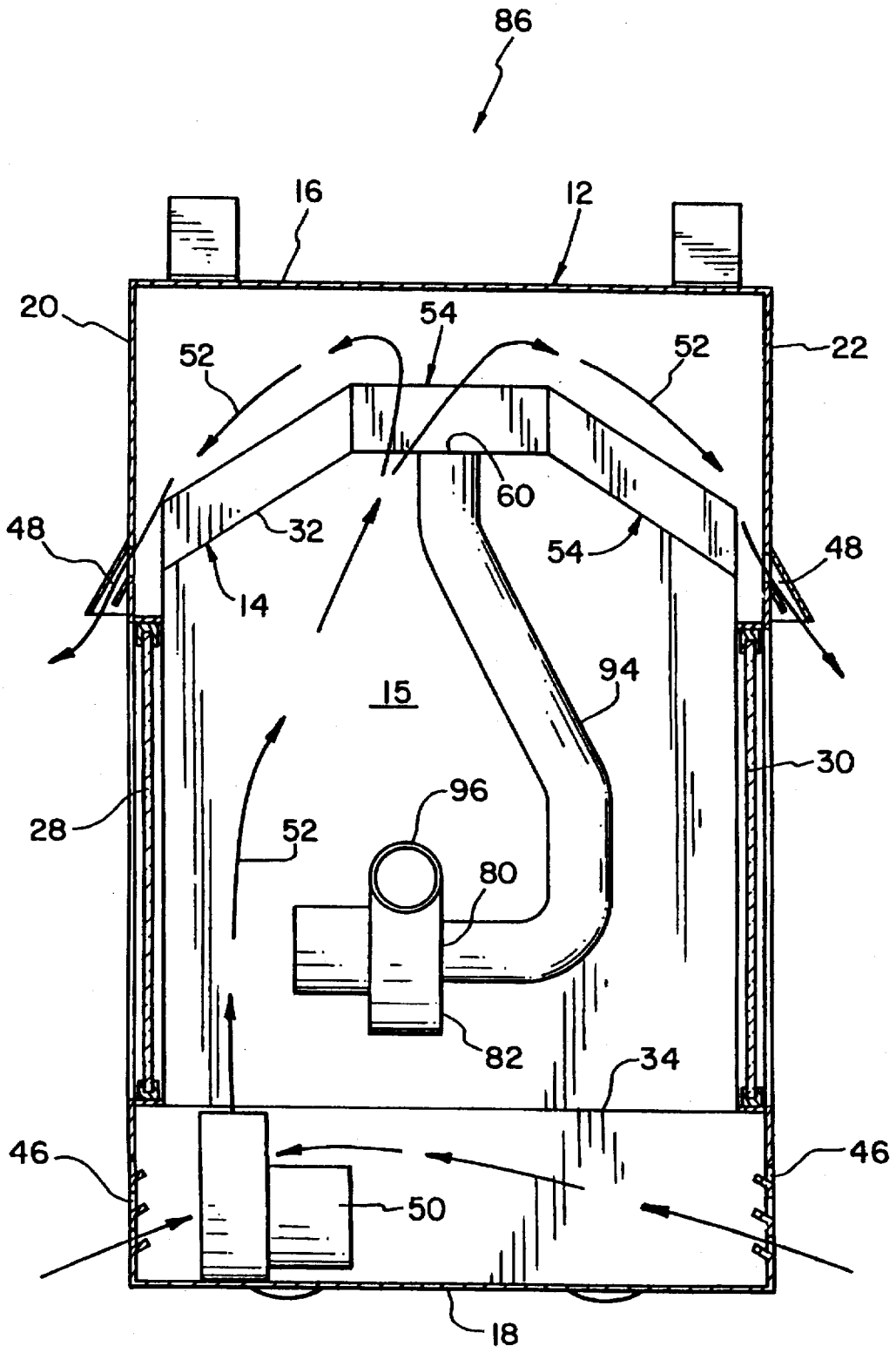
FIG. 6 is a side sectional view of the fireplace shown in FIG. 5.

Referring now to FIGS. 5 and 6, another embodiment of the present invention is shown. Similar to the embodiment shown in FIGS. 1–4, an induced draft fireplace 86 includes an outer front wall 20 and outer rear wall 22 which are each defined in part by respective glass doors 28, 30. However, it may also be seen that outer side wall 24 is defined in part by a glass door 88. Disposed below glass door 88 is an inlet 90 which is in fluid communication with room air circulation channel 44. Disposed above door 88 is an outlet 92 which is likewise in fluid communication with room air circulation channel 44.

Moreover, in contrast with the embodiment shown in FIGS. 1–4, a conduit 94 in the form of a tube extends from outlet 60 of heat exchanger 54 to inlet 80 of fan 82. Air exiting heat exchanger 54 is drawn through conduit 94 and enters fan 82. Fan 82 has an outlet 96 which extends through outer side wall 26.

Operation of the induced draft fireplace 86 shown in FIGS. 5–6 is essentially the same as that shown in FIGS. 1–4. Fan 82 induces a flow of combustion products from the combustion chamber through the heat exchanger and conduit 94. The combustion products are the exhausted to an outside ambient environment. Air being circulated through room air circulation channel 44 is drawn through three inlets and exhausted through three outlets, as opposed to two inlets and outlets with induced draft fireplace 10.

Each of the embodiments shown in FIGS. 1–4 and 5–6 include a heat exchanger 54 which splits a flow of combustion products into two partial flows in opposite direction along the sides of the heat exchanger. As a result, both the center portion and the sides of the heat exchanger are effectively used for maximizing the heat transfer efficiency of heat exchanger 54. Thus, in contrast with conventional designs wherein only the center portion of the heat exchanger is utilized for heat transfer purposes, the present invention has a design which more effectively utilizes all of the available heat transfer surfaces of heat exchanger 54.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An induced draft fireplace, comprising:

a plurality of outer walls defining an outer housing, said outer walls including at least one outer side wall and an outer top wall;

a plurality of inner walls defining a combustion chamber, said inner walls including at least one inner side wall, an inner bottom wall and an inner top wall having an outlet opening;

a room air circulation channel defined by and disposed between said outer housing and said combustion chamber, said room air circulation channel having an inlet and an outlet;

a heat exchanger disposed in said room air circulation channel intermediate said outer top wall of said outer housing and said inner top wall of said combustion chamber, said heat exchanger including an inlet connected to and in fluid communication with said combustion chamber outlet opening, and an outlet, said heat exchanger including a plurality of walls defining a combustion product flow path which is split into at least two partial flow paths, said combustion product flow path and said partial flow paths extending along said inner top wall of said combustion chamber, said combustion product flow path and each said partial flow path defining a total change in flow direction within said heat exchanger of at least 180°; and a fan having an inlet which is connected to add in fluid communication with said heat exchanger outlet, and an outlet for connection to a flue for transport of products of combustion from said combustion chamber, said fan disposed near said inner bottom wall.

2. The fireplace of claim 1, further comprising a plenum interconnecting said heat exchanger outlet and said fan inlet.

3. The fireplace of claim 1, wherein said plurality of heat exchanger walls are structured and arranged to split the flow of combustion products flowing through said heat exchanger into at least two partial flows of combustion products.

4. The fireplace of claim 3, wherein said heat exchanger comprises a two-pass heat exchanger.

5. The fireplace of claim 1, wherein said heat exchanger is defined in part by said inner top wall.

6. The fireplace of claim 1, wherein said plurality of outer walls further includes an outer front wall and an outer rear wall, each of said outer front wall and said outer rear wall comprising a predominantly glass panel.

7. The fireplace of claim 6, wherein each said glass panel comprises a predominantly glass door.

8. The fireplace of claim 1, wherein said plurality of outer walls comprise six outer walls including an outer front wall, an outer rear wall and two outer side walls, each of said outer front wall and said outer rear wall, and one of said outer side walls comprising a predominantly glass panel.

9. An induced draft fireplace, comprising:

a plurality of outer walls defining an outer housing, said outer walls including at least one outer side wall and an outer top wall;

a plurality of inner walls defining a combustion chamber, said inner walls including at least one inner side wall and an inner top wall having an outlet opening;

a room air circulation channel defined by and disposed between said outer housing and said combustion chamber, said room air circulation channel having an inlet and an outlet;

a heat exchanger disposed in said room air circulation channel intermediate said outer top wall of said outer housing and said inner top wall of said combustion chamber, said heat exchanger including an inlet connected to and in fluid communication with said combustion chamber outlet opening, and an outlet, said heat exchanger including a plurality of walls defining a combustion products flow path which splits into at least two partial flow paths, said combustion product flow path and said partial flow paths extending along said inner top wail of said combustion chamber, said combustion products flow path and each said partial flow path defining a total change in flow direction within said heat exchanger of at least 180°;

a fan having an inlet which is connected to and in fluid communication with said heat exchanger outlet, and an outlet for connection to a flue for transport of products of combustion from said combustion chamber; and a plenum interconnecting said heat exchanger outlet and said fan inlet, said plenum defining a flow path extending in a generally vertical direction.

10. The fireplace of claim 9, wherein said plenum comprises a tubular elongated member.

11. The fireplace of claim 9, wherein said plenum is defined in part by one of said inner side walls.

12. An induced draft fireplace, comprising:

a plurality of outer walls defining an outer housing, said outer walls including at least one outer side wall and an outer top wall;

a plurality of inner walls defining a combustion chamber, said inner walls including at least one inner side wall and an inner top wall having an outlet opening;

a room air circulation channel defined by and disposed between said outer housing and said combustion chamber, said room air circulation channel having an inlet and an outlet;

a heat exchanger disposed in said room air circulation channel between at least one of said outer top wall and said inner top wall, and one of said outer side walls and one of said inner side walls, said heat exchanger including an inlet connected to and in fluid communication with said combustion chamber outlet opening, and an outlet, said heat exchanger including a plurality of walls defining at least two flow path extending in different directions across said inner top wall of said combustion chamber, said at least two flow paths defining a total change in flow direction within said heat exchanger of at least 180°; and a fan having an inlet which is connected to and in fluid communication with said heat exchanger outlet, and an outlet for connection to a flue for transport of products of combustion from said combustion chamber.

13. The fireplace of claim 12, further comprising a blower disposed in said room air circulation channel for effecting a flow of forced air through said room air circulation channel.

14. An induced draft fireplace, comprising:

a plurality of outer walls defining an outer housing, said outer walls including an outer top wall, an outer bottom wall and four outer side walls, at least two of said outer side walls each comprising a glass panel;

a plurality of inner walls defining a combustion chamber, said inner walls including at least one inner side wall, an inner bottom wall and an inner top wall having an outlet opening which is generally centered in said inner top wall;

a room air circulation channel defined by and disposed between said outer housing and said combustion chamber, said room air circulation channel having an inlet and an outlet;

a heat exchanger disposed in said room air circulation channel intermediate said outer top wall and said inner top wall, said heat exchanger including an inlet connected to and in fluid communication with said combustion chamber outlet opening, and an outlet, said heat exchanger including a plurality of walls defining a combustion product flow path which splits into at least two partial flow paths, said combustion product flow path and said partial flow path extending along said inner top wall of said combustion chamber, said combustion products flow path and each said partial flow path defining a total change in flow direction within said heat exchanger of at least 180°; and a fan having an inlet which is connected to and in fluid communication with said heat exchanger outlet, and an outlet for connection to a flue for transport of products of combustion from said combustion chamber, said fan disposed near said inner bottom wall.

15. A see-through fireplace, comprising:

a plurality of outer walls defining an outer housing, said outer walls including an outer top wall, an outer bottom wall, an outer front wall, an outer rear wall and two outer side walls, said outer front wall and said outer rear wall each comprising a glass panel;

a plurality of inner walls defining a combustion chamber, said inner walls including at least one inner side wall and an inner top wall having an outlet opening;

a room air circulation channel defined by and disposed between said outer housing and said combustion chamber, said room air circulation channel having an inlet and an outlet;

a heat exchanger disposed in said room air circulation channel above said combustion chamber, said heat exchanger including an inlet connected to and in fluid communication with said combustion chamber outlet opening, and an outlet, said heat exchanger including a plurality of walls defining a combustion product flow path which splits into at least two partial flow paths, said combustion product flow path and said partial flow path extending along said inner top wall of said combustion chamber, said combustion products flow path and each said partial flow path defining a total change in flow direction within said heat exchanger of at least 180°; and a fan having an inlet which is connected to and in fluid communication with said heat exchanger outlet, and an outlet for connection to a flue for transport of products of combustion from said combustion chamber, said fan disposed near said inner bottom wall.

16. The see-through fireplace of claim 15, further comprising a plenum interconnecting said heat exchanger outlet and said induced draft fan inlet.

17. The see-through fireplace of claim 15, wherein one of said outer side walls disposed opposite an other of said outer side walls through which said fan outlet extends, comprises a glass panel.

18. A see-through fireplace, comprising:

a plurality of outer walls defining an outer housing, said outer walls including an outer top wall, an outer bottom wall, an outer front wall, an outer rear wall and two outer side walls, said outer front wall and said outer rear wall each comprising a glass panel;

a plurality of inner walls defining a combustion chamber, said inner walls including at least one inner side wall and an inner top wall having an outlet opening;

a room air circulation channel defined by and disposed between said outer housing and said combustion chamber, said room air circulation channel having an inlet and an outlet;

a heat exchanger disposed in said room air circulation channel above said combustion chamber, said heat exchanger including an inlet connected to and in fluid communication with said combustion chamber outlet opening, and an outlet, said heat exchanger including a plurality of walls at least two flow paths extending in different directions along said inner top wall of said combustion chamber, said at least two flow paths defining a total change in flow direction within said heat exchanger of at least 180°;

a fan having an inlet which is connected to and in fluid communication with said heat exchanger outlet, and an outlet for connection to a flue for transport of products of combustion from said combustion chamber, said fan disposed near said inner bottom wall; and a plenum disposed laterally of said glass panels interconnecting said heat exchanger outlet and said fan inlet, said plenum defining a flow path extending in a generally vertical direction.

* * * * *